US005573066A

United States Patent [19]

Vaillancourt et al.

[11] Patent Number: 5,573,066

[45] Date of Patent: Nov. 12, 1996

[54] REMOTE FUEL STATION

[75] Inventors: Greg Vaillancourt, Val Caron; Donald Sissons, Azilda, both of Canada

[73] Assignee: Valcom Mechanical Limited, Ontario, Canada

[21] Appl. No.: 372,382

[22] Filed: Jan. 13, 1995

[30] Foreign Application Priority Data

Jan. 13, 1994 [CA] Canada ..... 2113399

[51] Int. Cl.[6] ..... A62C 3/06

[52] U.S. Cl. ..... 169/49; 169/54; 169/66; 222/108; 222/608

[58] Field of Search ..... 169/49, 52, 54, 169/66; 222/108, 608; 137/356

[56] References Cited

U.S. PATENT DOCUMENTS

| | | | |
|---|---|---|---|
| 247,490 | 9/1881 | Fisler . | |
| 2,944,563 | 7/1960 | De Blasio . | |
| 2,946,377 | 7/1960 | Zoll et al. . | |
| 3,685,567 | 8/1972 | Pemberton et al. . | |
| 5,022,452 | 6/1991 | Burrell . | |
| 5,114,046 | 5/1992 | Bryant . | |
| 5,305,926 | 4/1994 | Webb | 222/183 |
| 5,400,924 | 3/1995 | Brodie | 222/108 |

FOREIGN PATENT DOCUMENTS

| | | | |
|---|---|---|---|
| 951219 | 7/1974 | Canada . | |
| 2000681 | 9/1990 | Canada . | |
| 343753 | 11/1989 | European Pat. Off. | 169/66 |

*Primary Examiner*—Gary C. Hoge
*Attorney, Agent, or Firm*—Woodard, Emhardt, Naughton Moriarty & McNett

[57] ABSTRACT

A remote fuel station designed for fuelling of equipment in potentially hazardous situations such as in mines comprises an enclosed container that is adapted to receive a fuel tank or bladder and which includes a containment volume capable of holding the entire contents of the tank or bladder in the event of rupture of the latter. The station also includes a door arrangement adapted to effectively seal the interior to cut off air supply if a fire should develop, and also includes a sprinkler system or a chemical fire suppressant arrangement.

11 Claims, 4 Drawing Sheets

REMOTE FUEL STATION

BACKGROUND OF THE INVENTION a) Field of the Invention

This invention relates to a new or improved remote fuel station that is particularly suitable for use in the fuelling of vehicles and other equipment in potentially hazardous locations such as in underground mines.

b) Description of the Prior Art

The dangers inherent in the fuelling of vehicles and other equipment in underground mines is well recognized, and in most jurisdictions there is legislation establishing the various safety requirements that must be met. Typically there is a requirement for a containment area that is capable of holding well in excess of the maximum volume of fuel that can be stored in the fuelling area. Additionally, the fuelling area must be provided with doors to contain smoke and to limit oxygen supply in the event of a fire, and must be equipped with a sprinkler system to extinguish flames and cool the area.

Conventionally a fuelling area in hard rock mines has been established by blasting a large cavern in the rock, and installing large doors to close off the cavern, concrete dykes to provide containment, a structure on top of the dykes to hold the fuel tanks, and a sprinkler arrangement. Since the fuelling area must be large enough to enable equipment to be driven in and out of the cavern, the latter must be quite large, and although the described arrangement is effective, it is very costly to construct. Additionally such a fuelling station is permanent in nature being at a fixed location which as mine development proceeds may become an unfavourable location because of the considerable distances that equipment has to travel from the working area to the fuelling area.

SUMMARY OF THE INVENTION

The present invention provides a fuel station comprising a rigid fire resistant shell having an interior that defines a chamber adapted to receive a liquid fuel container; containment means in said shell interior below said chamber providing a holding tank having a capacity sufficient to receive the entire contents of any fuel container which may be placed in said chamber; an opening in said shell providing access for insertion or removal of said fuel container with respect to said chamber; and a door mounted on said shell to be movable from an open condition providing access to said chamber and a closed position wherein it closes said opening and effectively isolates the interior of said shell from surrounding atmosphere.

The fuel station preferably includes an automatic door closing arrangement, e.g. including a fusible link, which will respond to an excessive temperature condition such as a fire within the shell to close the door to cut off any supply of air to a fire or the like.

Additionally the fuel station may include a fire fighting system that will operate automatically to spray fire suppressing or fire retarding substances in and around the fuel cell in the event that an excessive temperature arises. The system may include a water sprinkler system or a dry chemical fire suppressant arrangement.

The fuel station shell preferably provides a grid to support a fuel tank or bladder, and beneath the grid a well of a capacity of at least 110% of the maximum capacity of the fuel tank or bladder. The shell will also preferably include hose connections through its wall for coupling the internal fuel tank to an outside fuel pump and hose reel arrangement.

The fuel station is thus self-contained, and is preferably of a portable nature so that it can be transported from one location to another as the need arises. For example, the fuel station may be designed to be engaged and lifted by the tines of a fork lift truck.

The advantages of this feature will be readily appreciated in an underground mine situation where the fuel station can be moved when the working area changes. Additionally the construction costs of the fuel station will typically be considerably less than the previously required construction of a cavern and the associated doors and dykes.

BRIEF DESCRIPTION OF THE DRAWINGS

The invention will further be described, by way of example only, with reference to the accompanying drawings wherein.

DESCRIPTION OF THE PREFERRED EMBODIMENT

Figure 1:
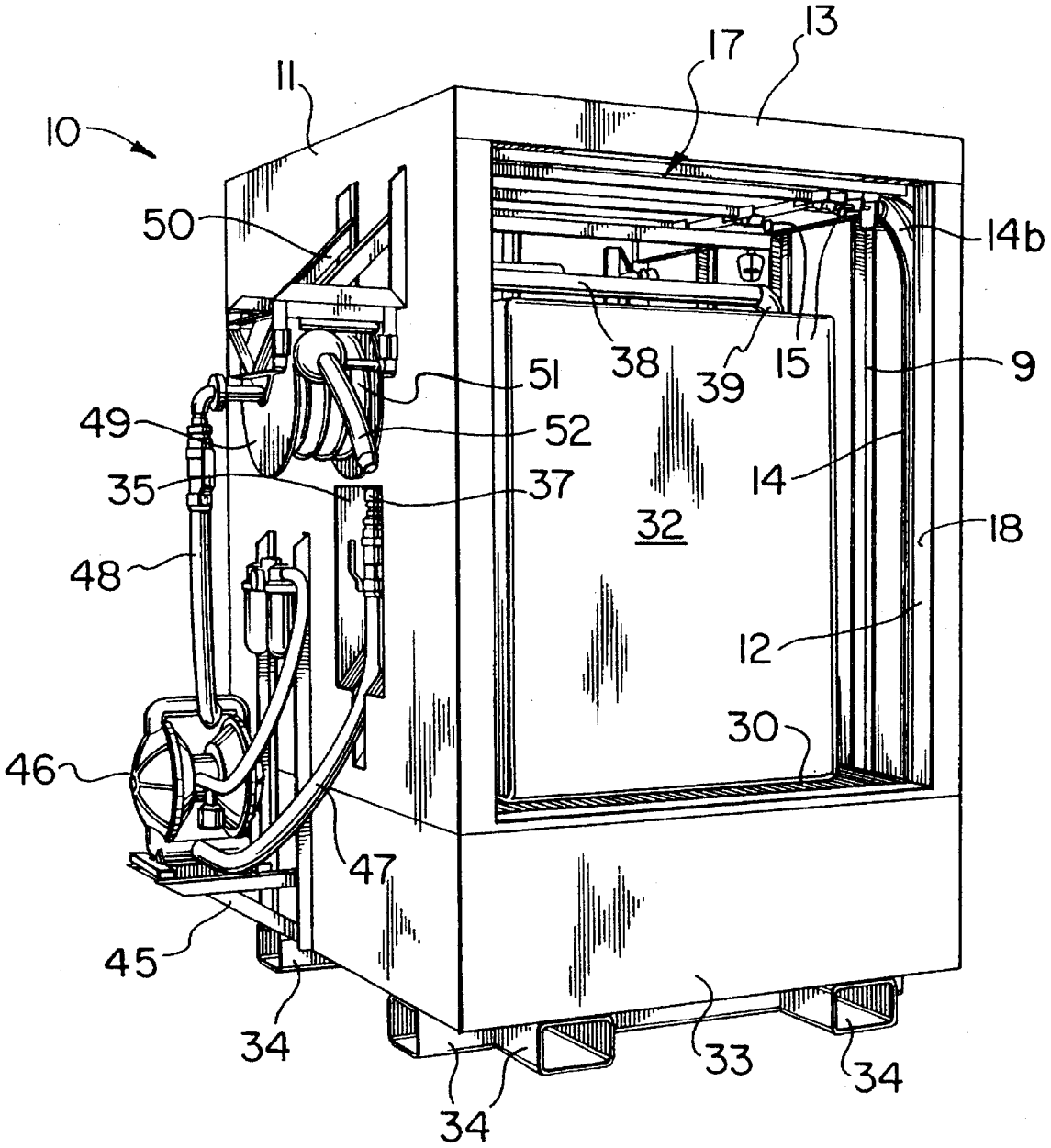
FIG. 1 is a prospective view from the front and from one side showing a preferred embodiment of a fuel station in accordance with the invention.
Figure 3:
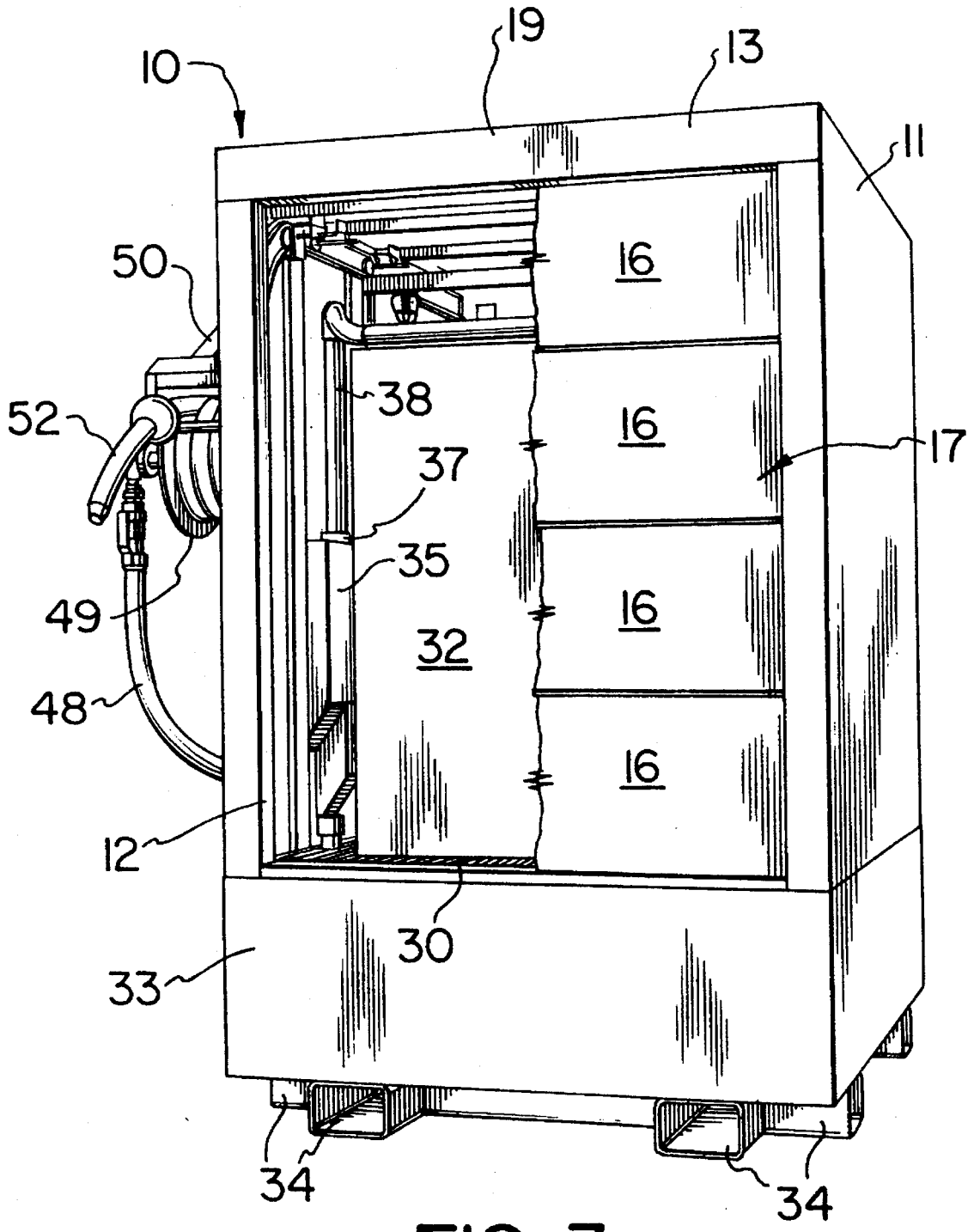
FIG. 3 is a front perspective view showing the fuel station with its door closed.

With reference to FIG. 1 the fuel station generally indicated at 10 comprises a shell 11 of box-shaped form having fire-resistant walls formed from steel or the like secured to a steel frame 9 and forming an enclosure having a large door opening 12 in the front wall 13 thereof. On each side of the door opening is mounted a channel section track 14 which receives and guides rollers 15 mounted at opposite ends of pivotally interconnected panels 16 of a vertically movable door 17. The tracks 14 guide the door panels 16 from movement between the closed position shown in FIG. 3 upwardly to the fully open position shown in FIG. 1, in the closed position there being a close fit between adjacent ones of the door panels 16 and between the door panels and the surrounding sides-of the door opening 12 so that in the door closed position the interior of the shell is substantially isolated from the surrounding atmosphere. Suitable latching and/or locking means (now shown) may be included to secure the door in its closed condition.

Figure 2:
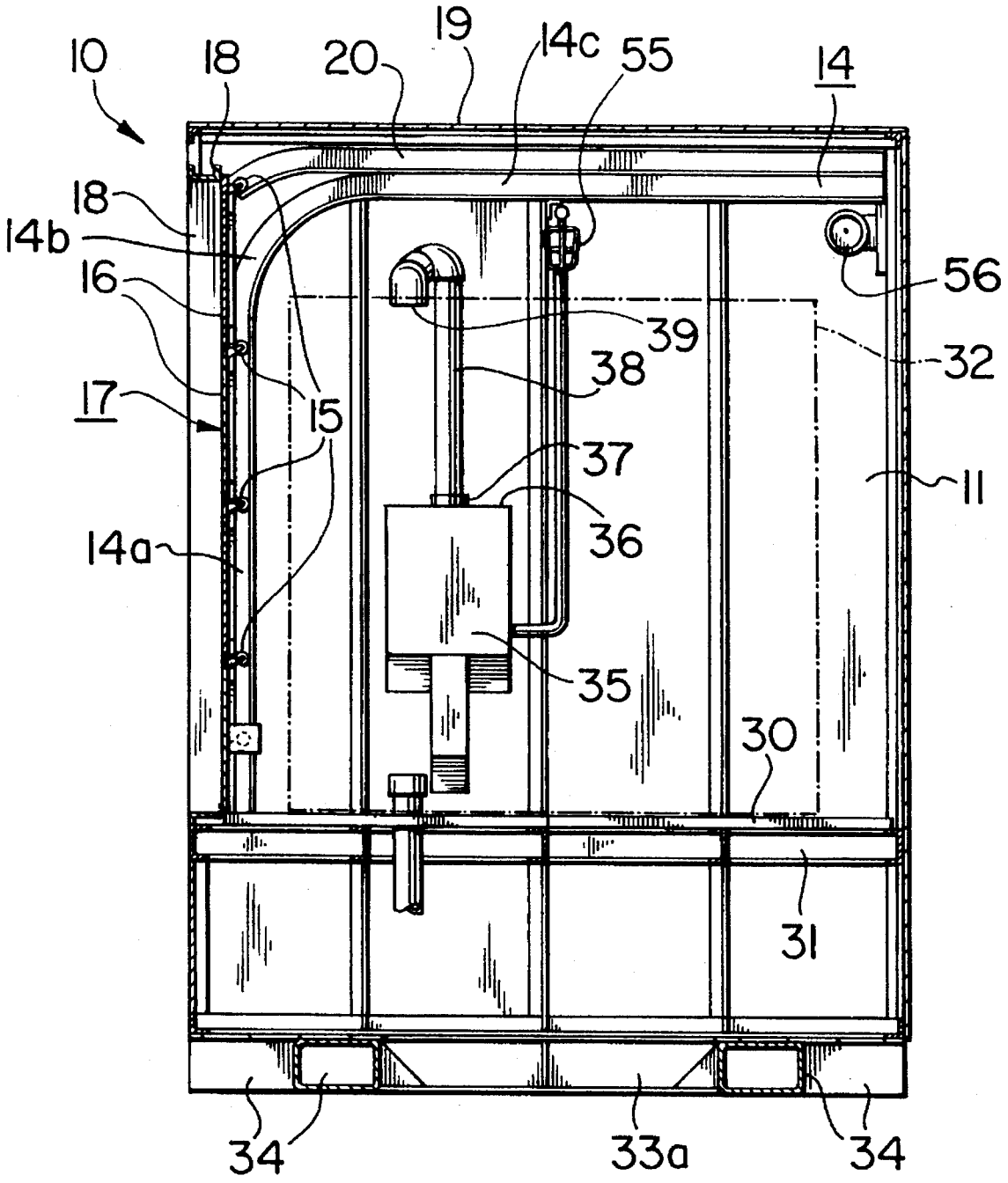
FIG. 2 is a sectional view of the fuel station taken in a central vertical plane.

As seen in FIG. 2, the door opening 12 has at the rear thereof a projecting peripheral flange 18, the track 14 being mounted vertically behind the flange 18 such that with the door in the closed position, the panels 16 thereof are closely adjacent or in contact with the flange 18.

As best seen in FIG. 2, the guide track 14 has a first vertical section **14*a*, a curved intermediate section 14*b*, and a horizontal upper section 14*c* positioned close to the top wall 19 of the shell 11**.

To ensure that the top panel 16 of the door seals properly against the flange 18, the guide rollers of the top panel 16 do not move in the tracks 14, but rather are adapted to move in a pair of auxiliary tracks 20 positioned above of the tracks 14 and adapted to receive the rollers of the top panel 16 so that the latter can move into full sealing contact with the flange 18 without interference from the large radius curve section 14*b* of the track 14.

At the level of the lower end of the doorway 12, the interior of the fuel station is spanned by a horizontal grill 30 supported above the lower end of the shell 11 by a horizontal frame structure 31 attached to the frame 9 of the shell 11. The grill 30 is of any suitable material and provides an open framework for the support of a fuel container in the form of a bladder 32 that can be positioned totally within the shell 11. The interior of the shell below the level of the door opening 12 constitutes a containment well 33 which has a capacity that comfortably exceeds the capacity of the largest fuel container that the fuel station is designed to receive. Typically this capacity is 110% of the capacity of the maximum sized fuel container to be received in the fuel station. The containment well 33 has an outline that corresponds to that of the shell 11, and has a central downwardly recessed portion 33*a* at opposite sides of which are pairs of rectangular sleeves 34 positioned at ground level and adapted to receive the tines of a fork lift vehicle (not shown). Pairs of such sleeves 34 are provided on each of the four sides of the station.

The fuel station includes means to deliver fuel from a tank or bladder 32 supported on the grill 30 to the exterior of the shell so that it can be delivered to a vehicle or other equipment. To this end, one side wall of the shell 11 as seen in FIG. 1 has a recessed panel 35 having a horizontal upper wall 36 which has sealed thereto a hose coupling 37 that is connected interiorly of the fuel station to a hose 38 that has a coupling 39 connected to the fuel bladder 32. On the exterior of the shell 11 a detachable bracket 45 provides a support for a pump 46 having an input connected to the coupling 37 through a hose 47, and an output connected to a hose 48 coupled to a hose reel 49 that is rotatably mounted on the shell 11 by means of a detachable bracket 50. A hose 51 mounted on the reel 49 has a delivery nozzle 52 and can be unreeled from the reel 49 to deliver fuel to equipment (not shown) in the vicinity of the fuel station 10.

The connector 39 on the hose 38 for attachment to the fuel bladder as well as the connectors at the ends of the hoses 47, 48 and 51 comprise "dry-disconnect" fittings which can be uncoupled with no or minimal dripping of fuel.

Figure 4:
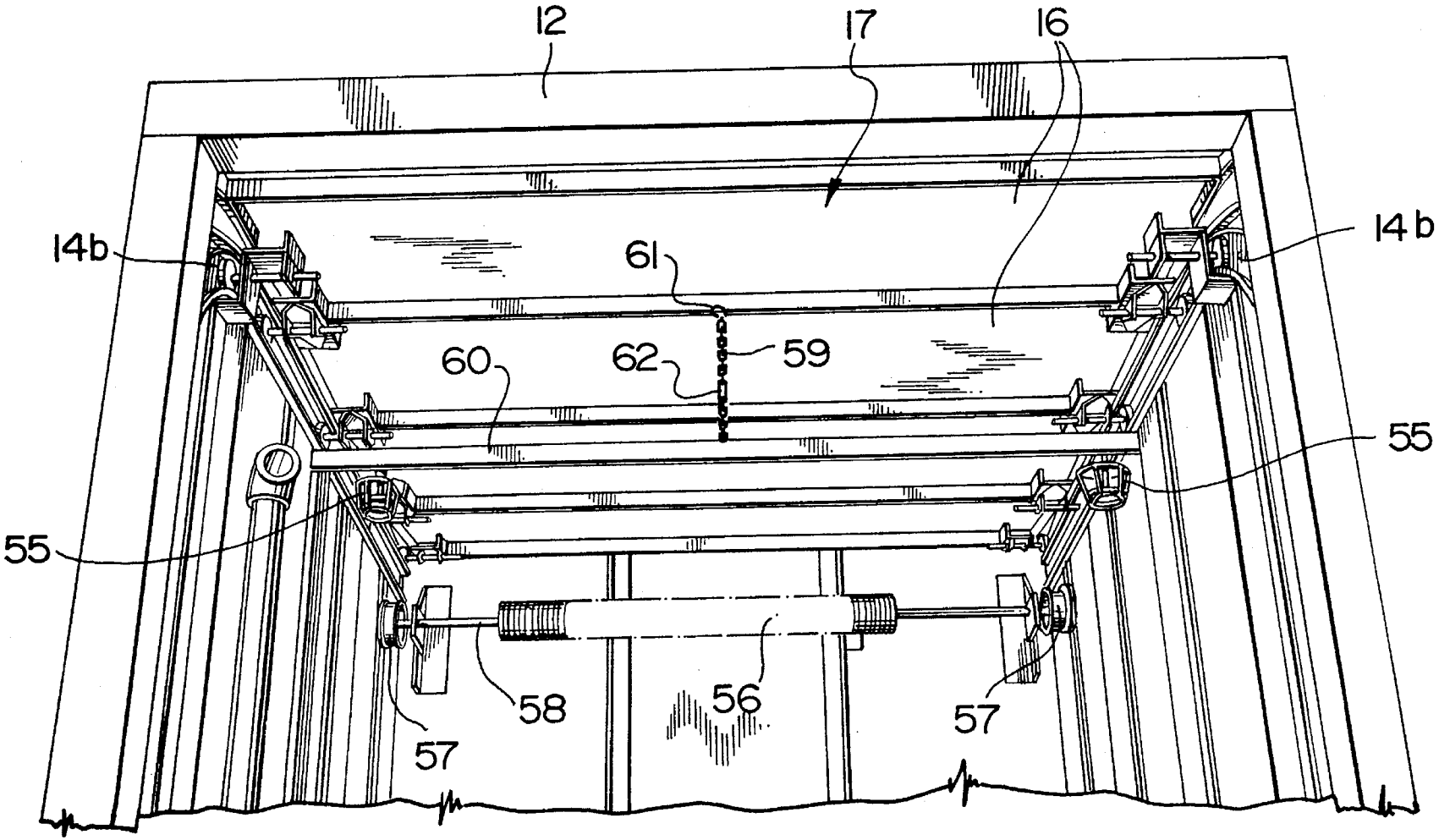
FIG. 4 is a fragmentary perspective view showing the upper interior portion of the fuel station.

The fuel station incorporates a fire retardant or fire repressant system formed for example by a series of internal and external water sprinklers 55 controlled by temperature sensitive detectors (not shown) which are arranged to actuate the sprinkler system, and also to close the door 17 when an excessive temperature condition is detected within the fuel station 10 or in the vicinity thereof. The door closing arrangement is best seen in FIG. 4. In known manner a counterbalancing torsion spring 56 is provided to counterbalance a portion of the weight of the door 17 to reduce the effort required to raise the door from its closed position. As the door is raised and the panels 16 successively have their roller supported in the upper horizontal portion 14C of the track, the effective weight of the door decreases. The torsion spring 56 is connected to the door in a well known manner by cable systems that wind on drums 57 at opposite ends of a torsion spring shaft 58. As the door 17 is raised, the drums 57 are rotated so that the torque applied by the torsion ring 56 is reduced. The components are so selected and arranged that throughout the door opening movement, the effective unbalanced weight of the door is in the range of about 10 to 20 pounds, and this weight persists even when the door is fully open as shown in FIG. 4, since in this condition the rollers 15 of the lowermost of the door panel 16 is still within the curved portion 14*b* of the track, and therefore there is a residual force urging the door downwardly.

To hold the door in the fully open position a chain 59 is provided, one end of the chain being hooked on a transverse supporting member 60 within the fuel station, and the opposite end of the chain being in hooked engagement with a mounting 61 in one of the door panels 16. Thus the chain holds the door in the fully open position against the residual downward force acting on the door. The chain includes a fusible link 62 that is adapted to be destroyed when exposed to a temperature above a predetermined level, and thus allow the door to close under its own weight. The fusible link 62 may be of any desired form. For example, it may consist of two flat pieces of steel that are partially overlapped and soldered together, each piece having a hole therein which is linked to an adjoining section of the chain 59. The solder liquidifies at a predetermined temperature allowing the flat pieces to separate and the door to close.

It will be appreciated that numerous other arrangements could be provided to effect closure of the door when hazardous conditions are detected. For example a latching structure (not shown) could be provided to hold the door in the fully open position, and a temperature sensor connected to release the latching structure in response to an excessive temperature. Additionally positive drive means could be provided to move the door to the closed position, rather than relying on gravity.

Under normal operating conditions the door 17 remains open so as to discourage the accumulation of dangerous levels of fuel vapours within the shell 11.

The fuel station may incorporate a power source (not shown) for driving the pump and the sprinkler system, or may be adapted for connection to an external power source of compressed air or electricity for example.

In addition to or in place of the sprinkler system, the fuel station may incorporate a chemical fire suppressant system (not shown) that is adapted to be actuated when a hazardous condition is detected. It will be appreciated that when the door 17 is closed, air supply to any fire within the shell is rapidly cut off so that flames are quickly extinguished through lack of oxygen, and also by the action of the fire suppressant system.

In the event of rupture of the fuel bladder 32 or fuel container supported on the grill 30, no liquid fuel will escape from the fuel station: rather it will drain through the open grill 30 into the containment well 33 in the bottom of the shell.

The containment well 33 may be provided with means to absorb limited quantities of fuel as may occur through seepage or leakage, to reduce the fire hazard that will be presented by the presence of an uncovered pool of liquid fuel therein. Additionally, the fuel station may include means to effect shutdown conditions and closure of the door 17 in response to excessive concentrations of fuel vapour within the shell, as might occur, for example, through rupture of the fuel container or bladder.

Thus the fuel station described above offers a number of advantages in that it is environmentally friendly to the extent that it utilizes dry disconnect fittings to minimize fuel spillage, and in that it provides a containment well to prevent fuel spillage through rupture or the like of the fuel tank or bladder. In addition there is a two-fold safety system in the event of fire within the shell in that closure of the door 17 cuts off air supply to any such fire, and the sprinkling and/or fire suppressant system will cool the interior of the shell and extinguish any flames.

The fuel station described is economical to build without requiring any exotic materials, and can be readily modified to suit a wide range of requirements and to accommodate standards commercially available fuel tanks. Particularly in an underground mine situation the fuel station offers considerable advantages over the above described prior art system in that the fuel station is readily transportable and thus can always be kept at a location that is most convenient to the working area of the equipment that is being fuelled.

The pump 46 and the hose reel 49 together with their supporting brackets can be readily removed from the exterior of the fuel station shell, e.g. to avoid damage during transportation of the fuel station.

We claim:

1. A fuel station comprising a rigid fire-resistant shell having an interior that defines a chamber adapted to receive a liquid fuel container;

containment means in said shell interior below said chamber providing a holding tank having a capacity sufficient to receive the entire contents of any fuel container which may be placed in said chamber;

an opening in said shell providing access for insertion or removal of said fuel container with respect to said chamber; and a door mounted on said shell to be movable from an open condition providing access to said chamber and a closed position wherein it closes said opening and effectively isolates the interior of said shell from surrounding atmosphere.

2. A fuel station as claimed in claim 1 further including door closing means that is adapted to operate automatically in response to the existence in the vicinity of said station of a temperature above a predetermined level.

3. A fuel station as claimed in claim 1 further including a fire fighting system automatically operable to spray fire suppressing or fire retarding substances on said fuel station upon detection of a fire hazard condition.

4. A fuel station as claimed in claim 3 wherein said firefighting system is a sprinkler system.

5. A fuel station as claimed in claim 3 wherein said firefighting system is a dry chemical system.

6. A fuel station as claimed in claim 1 including a pump adapted to be coupled to draw fuel from a fuel container when present in said chamber and deliver such fuel to a hose reel which is mounted on said shell and which can be unwound to distribute fuel to a vehicle or the like.

7. A fuel station as claimed in claim 6 including fuel lines that include "dry-disconnect" quick release couplings for attachment to the fuel container and to said pump.

8. A fuel station as claimed in claim 7 wherein said pump and said hose reel are mounted externally of said shell and wherein the fuel line through which the pump draws fuel from the fuel container passes through a connection sealed in the wall of said chamber.

9. A fuel station as claimed in claim 1, said fuel station being portable.

10. A fuel station according to claim 9 wherein said shell includes formations to be engaged by the tines of a forklift truck by means of which the fuel station can be lifted and transported.

11. A fuel station as claimed in claim 1 wherein the door is adapted to close a large rectangular doorway in one side of said shell and comprises a series of door sections that are pivotally interconnected and are guided at their ends by rollers carried on the door sections and engaging in guide channels at the edges of said doorway to guide movement of the door between the open condition and the closed condition thereof.

* * * * *